US005632464A

United States Patent [19]

Aberle

[11] Patent Number: 5,632,464

[45] Date of Patent: May 27, 1997

[54] GROUND POCKET SUPPORT

[76] Inventor: Steven C. Aberle, 6820 Orion Ct., Arvada, Colo. 80007

[21] Appl. No.: 523,347

[22] Filed: Sep. 5, 1995

[51] Int. Cl.[6] ..... F16M 13/00

[52] U.S. Cl. ..... 248/530; 52/298

[58] Field of Search ..... 248/530, 532, 248/533, 545, 156, 507; 52/165, 298

[56] References Cited

U.S. PATENT DOCUMENTS

| | | | |
|---|---|---|---|
| 28,958 | 7/1860 | Blood et al. | 52/165 |
| 199,949 | 2/1878 | Youngs | 52/165 |
| 844,726 | 2/1907 | Hunter | 52/165 |
| 3,066,769 | 5/1962 | Pasquale | 189/29 |
| 3,441,239 | 4/1969 | Frost | 248/545 |
| 4,271,646 | 6/1981 | Mills | 52/165 |
| 4,324,388 | 4/1982 | Klaser | 256/19 |
| 4,588,157 | 5/1986 | Mills | 248/545 |
| 4,644,713 | 2/1987 | Lehman | 52/165 |
| 4,874,149 | 10/1989 | Miceli | 248/530 |
| 5,090,656 | 2/1992 | Brown | 248/530 X |

*Primary Examiner*—Ramon O. Ramirez
*Attorney, Agent, or Firm*—John L. Isaac

[57] ABSTRACT

A ground pocket support device is disclosed for removably mounting a post having variable cross-section shape and size. The ground pocket support device includes an elongate ground engaging member having upper and lower end portions. The member is adapted for placement in the ground and defines a hollow post-receiving portion for receiving and supporting a post in a substantially upright position. The ground engaging member further includes elongate wall members and a post wedging mechanism positioned toward the lower end portion for firmly engaging the lower end of a post inserted therewithin. A post-engaging member is disposed at the upper end portion of the ground engaging member. The post-engaging member includes members for removably anchoring a post inserted within the ground engaging member and for adjusting the vertical alignment of the post independent of the vertical alignment between the ground engaging member and the ground in which it is placed.

28 Claims, 4 Drawing Sheets

GROUND POCKET SUPPORT

BACKGROUND OF THE INVENTION

1. Field of the Invention

This invention relates generally to systems designed to hold fence posts and the like in the ground and, more particularly, to post support devices utilized to assist in the insertion of posts into the ground. Specifically, the present invention relates to a ground pocket support device adapted to receive posts of variable sizes for removable mounting in the ground.

2. Description of the Prior Art

Stake pocket devices have long been used to mount and support stakes or posts in a variety of applications. One common application is for the support of stakes along the bed of a vehicle such as a flatbed truck or wagon. Another such application is for the support of posts which are designed for insertion into the ground. Early examples of such fence post applications include U.S. Pat. Nos. 28,958; 199,949 and 844,726. Despite such early attempts to provide fence post supports for ease of construction, it is still a common practice to erect and support post members by digging a hole of suitable depth and either burying one end of the post in the hole with earth or by supporting the post in the hole by filling the hole with concrete or the like.

A series of devices have been created in order to assist in assembling such fence posts. Examples of such devices include U.S. Pat. Nos. 3,066,769; 4,271,646; 4,324,388; 4,588,157; 4,644,713 and 4,874,149. Almost all of these devices operate by providing a severely tapered body terminating in a point which is designed for first piercing and then being pushed into the earth. These bodies then have an upper receiving cup which is designed to receive and carry the post.

Several significant problems remain despite the advantages of the devices listed above. One significant problem common to all post mounting mechanisms, whether they use concrete as previously described or are erected utilizing one of the devices disclosed above, is that fence posts are frequently sheared at their juncture with the earth's surface as the result of pressure created against the post. Such pressure can be created, for example, by collision with moving vehicles or by vandalism. Once such damage to the fence post occurs, the post must be dug out and removed from the ground whether it is immersed in concrete or is in one of the post supports previously described. In fact, not only must the post be dug out, but the concrete or post support must also be dug out of the ground. A new post must then be remounted utilizing concrete or another post support. Such post removal and replacement is very time consuming and very difficult particularly in winter weather.

Another problem inherent with the prior art devices or mounting systems illustrated by the above is that the post needs to be aligned in a substantially vertical orientation. When concrete is utilized to mount the post, the person installing the fence post must insure that the post remains vertically aligned during the curing and setting of the concrete. Otherwise, the post can easily tilt, creating a fence post that is significantly out vertical alignment. When prior art support devices as those described above are utilized, the support device must be carefully inserted into the ground so that is in fact vertically aligned. Otherwise, any misalignment of the support member will create a similar misalignment in the fence post mounted to the support member.

Therefore, there is still a need for a ground pocket support device which permits ease of post replacement as well as permits adjustable vertical alignment.

SUMMARY OF THE INVENTION

Accordingly, it is one object of the present invention to provide an improved ground pocket support for posts of various width dimensions and shapes.

Another object of the present invention is to provide a ground pocket support device which permits easy replacement of the post disposed therewithin after the support device has been positioned in the ground.

Yet another object of the present invention is to provide an improved ground pocket support which permits adjusting the vertical alignment of the post disposed therein independent of the vertical alignment of the pocket support placed in the ground.

To achieve the foregoing and other objects and in accordance with the purpose of the present invention, as embodied and broadly described herein, a ground pocket support device is disclosed for removably mounting a post having variable cross-section shape and size. The ground pocket support device includes an elongate ground engaging member having upper and lower end portions. The member is adapted for placement in the ground and defines a hollow post-receiving portion for receiving and supporting a post in a substantially upright position. The ground engaging member further includes elongate wall members and a post wedging mechanism positioned toward the lower end portion for firmly engaging the lower end of a post inserted therewithin. A post-engaging member is disposed at the upper end portion of the ground engaging member. The post-engaging member includes members for removably anchoring a post inserted within the ground engaging member and for adjusting the vertical alignment of the post independent of the vertical alignment between the ground engaging member and the ground in which it is placed.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Prior ground pocket post supports have generally been designed to receive specifically sized and shaped posts or stakes, which have normally been square in cross-section. Heretofore, there has not been a universal-type of ground pocket post support designed to receive both square as well as annular-shaped post of varying width dimensions. Moreover, prior devices have focused on enhancing the process of inserting of the post into the ground and have thus been adapted for fixed attachment to the post. The ground pocket support device of the present invention can be utilized to provide a base for mounting posts in the ground in a manner wherein the post can be easily replaced as well as vertically aligned after securing the pocket support in the ground.

Figure 1:
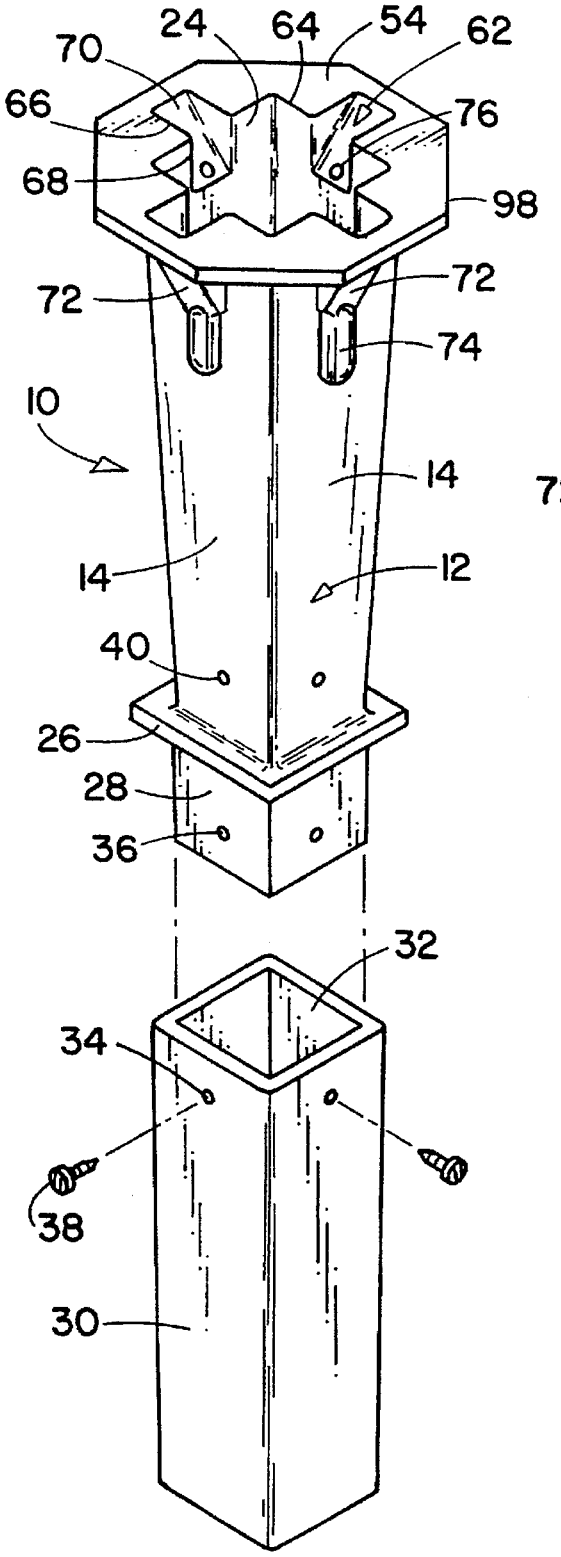
FIG. 1 is a side perspective view of the ground pocket support device of the present invention.
Figure 2:
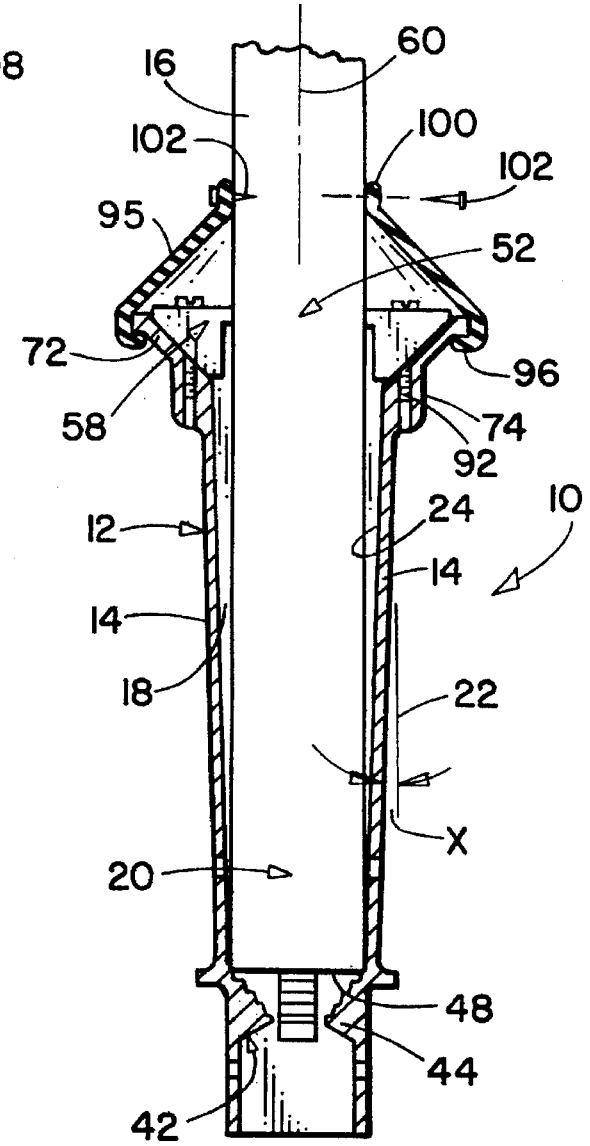
FIG. 2 is a cross-sectional view of the ground pocket support device of the present invention illustrating a post mounted therewithin.

Referring now to FIGS. 1 and 2, a ground pocket support 10 includes an elongate body portion 12 that is made up of a plurality of elongate wall members 14. The number, shape and arrangement of the wall members 14 may be as desired to create a cross-section for elongate body 12 ranging from rectangular to annular as well as any other desired cross-sectional shape. In preferred form, there are four wall members 14 of equal size to create a rectangular, and most preferably a square, cross-section for the elongate body 12. A square cross-section for the elongate body 12 is preferred since it is readily used with a post 16 of rectangular or annular cross-section. The pocket support 10 can be made from any desired type of metal material such as aluminum, ductile iron, steel and stainless steel. In preferred form, the pocket support 10 is cast from aluminum.

The walls 14 form a hollow chamber 18 which is adapted to receive the post 16. In preferred form, the walls 14 are tapered from their upper portion to their lower portion in order to assist in wedging of the lower portion 20 of the post 16 within the hollow cylinder 18. Preferably, the angle of taper that the walls 14 make with the vertical axis 22 is designated by the angle X and is approximately 1°–5°and more preferably 2°. In this manner, the bottom portion 20 of the post 16 can be wedged against the inner surfaces 24 of the walls 14 as a post 16 is inserted within the chamber 18. If the taper is greater than about 5°, there will be too much open space at the upper end portion of the body 12, and if the taper is less than 1°, then there is now wedging effect from the walls 14 on the post 16. In preferred form, the body 12 is approximately 4¾" in width at its upper portion and tapers down to about 3¾" over 18 inches in length. This is particularly adaptable to a 4"×4" post.

In the preferred embodiment of the present invention, an exterior lip or rim 26 is disposed about the perimeter of the elongate body 12 proximate its lower end portion. A lower connection portion 28 of the body 12 projects below the rim 26 and preferably has the same cross-sectional shape as the upper body portion 12 defined by the walls 14. However, it is preferred that the cross-section of the connection portion 28 is of a lesser dimension than the cross-section of the body 12 immediately above the rim 26. An extension tube 30 having a cross-section similar to that of the connection portion 28 is sized and shaped to receive the connection portion 28 within the opening 32 thereof. The extension tube 30 is preferably constructed from steel and is provided as an option to create a longer pocket support 10 when certain environmental considerations require the same. The extension tube 30 may be sized to snugly press-fit or be wedged over the connection portion 28. Moreover, apertures 34 may be provided in the upper end of the extension tube 30 with apertures 36 being provide in the connection portion 28 in aligned position so that attachment members 38, such as screws, may be utilized to secure the extension tube 30 to the elongate body 12. It should also be noted that apertures 40 may be provided in the walls 14 immediately above the rim 26 as fluid drain ducts in the event fluid enters the chamber 18. In certain instances, an extension tube of 3 ft. to 5 ft. in length will avoid the requirement of encasing the support post 10 in concrete in the ground.

Figure 2A:
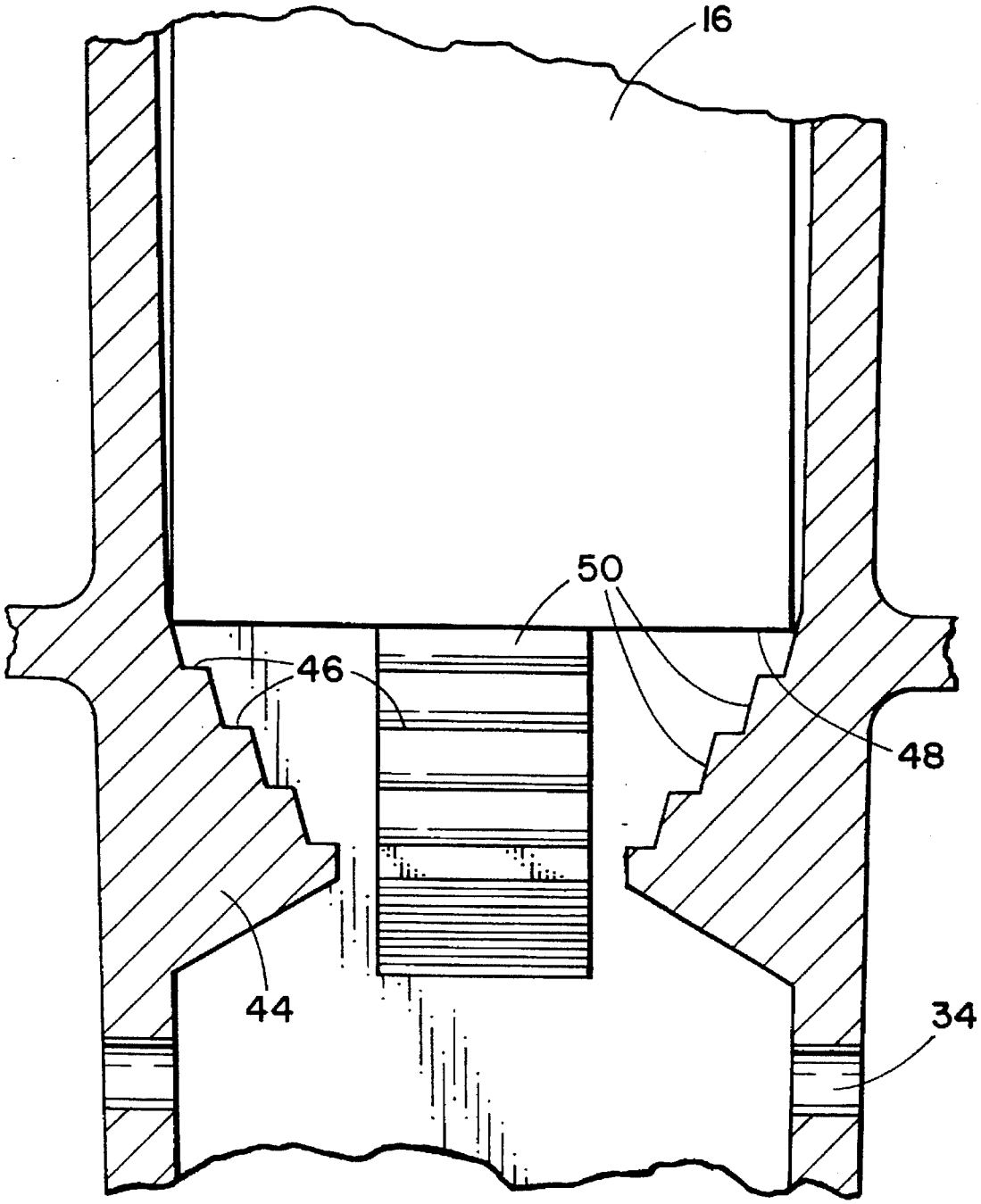
FIG. 2A is an enlarged partial cross-sectional view illustrating the post lowermost end engagement members.
Figure 3:
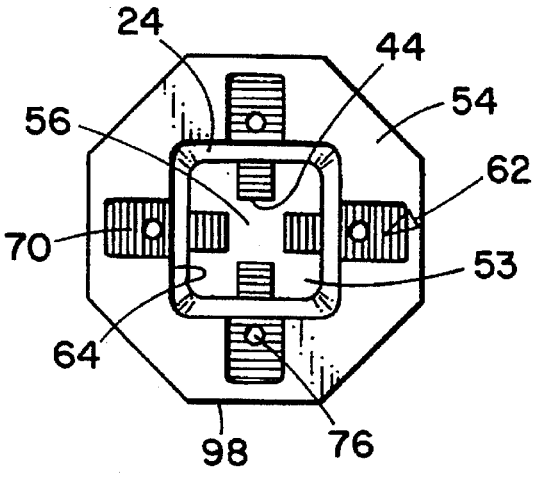
FIG. 3 is a top plan view of the embodiment illustrated in FIG. 1.
Figure 4:
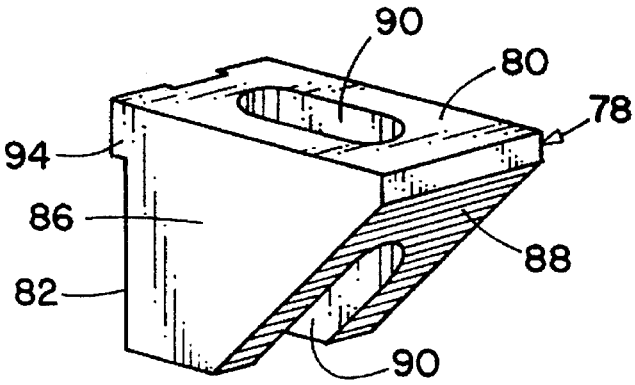
FIG. 4 is front perspective view of one embodiment of the anchor mount utilized with the present invention.
Figure 5:
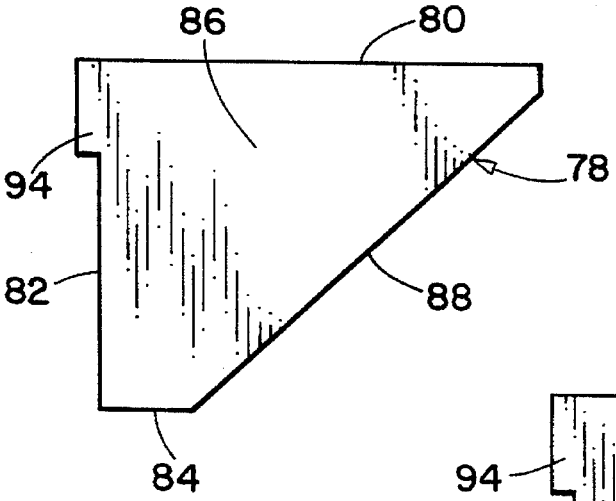
FIG. 5 is side view of the anchor mount illustrated in FIG. 4.
Figure 6:
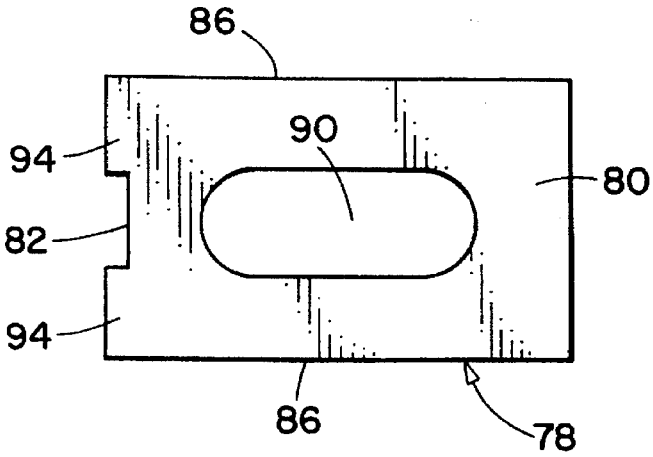
FIG. 6 is a top plan view of the anchor mount illustrated in FIG. 4.
Figure 7:
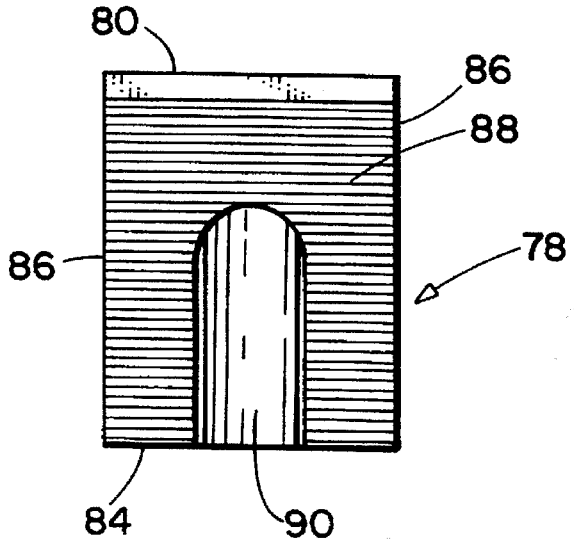
FIG. 7 is a front view of the anchor mount illustrated in FIG. 4.
Figure 8:
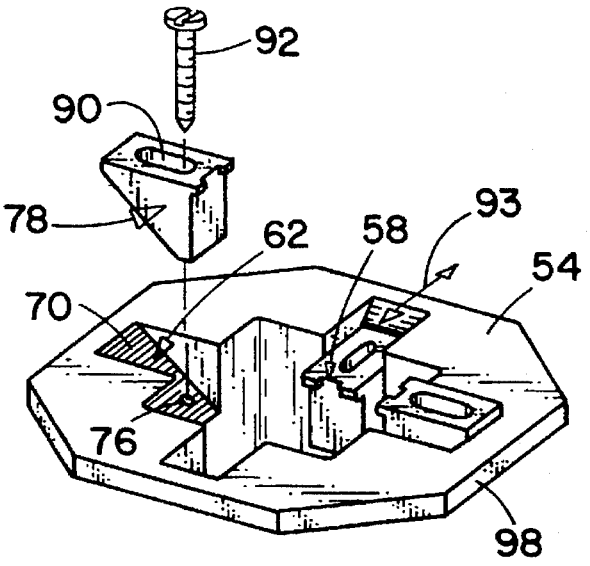
FIG. 8 is a perspective view of the top plate portion of the pocket support device of the present invention illustrating the anchor mounts in various different positions relative thereto.
Figure 9:
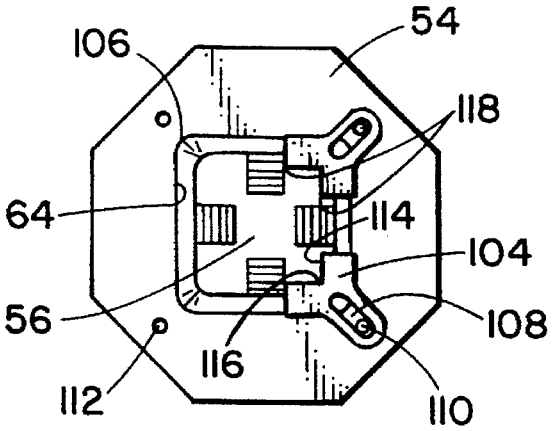
FIG. 9 is a top plan view of the top plate of the present invention similar to FIG. 3 but illustrating an alternate anchor mount embodiment.

Referring particularly to FIGS. 1, 2 and 2A, a post mounting mechanism 42 is disposed in the lower portion of the elongate body 12 and is adapted to push against the bottom portion 20 of the post 16 inserted within the chamber 18 to hold it in place therewithin. In preferred form, each inner surface 24 of a wall 14 includes a wedge member 44 that is made up of a plurality of steps 46 in the form of sills on which the bottom surface 48 of the post 16 may rest. Each step of sill 46 is interconnected to its adjacent step or sill 46 by an angular or wedge shaped surface 50 and is preferably at an angle of approximately 30° relative to the vertical axis 22. In this manner, depending upon the width dimension of the post 16, the bottom portion 20 is wedged against a beveled surface 50 by downward pressure against the post 16 until the bottom surface 48 rests against a sill 46. The beveled surface 50 provide lateral inward pressure against the bottom portion 20 of the post 16 to assist in maintaining the post 16 within the pocket support 10. However, but to the taper of the walls 14, the upper area 52 of the post 16 within the device 10 does not come into contact with the surfaces 24 of the walls 14 and is therefore free to be adjusted relative to the vertical axis 22 of the body 12. In addition, since each wedge member 44 is positioned approximately at the center portion of the wall 14, the open spaces 53 between the plurality of wedge members 44 permits liquid to pass through the length of the post 10 to prevent accumulation of standing water, which can cause dry rot of the post 16 if the post 16 is constructed from wood.

Referring now to FIGS. 1–8, the upper portion of the elongate body 12 includes, in preferred form, a top plate 54 which defines a central opening 56 for the hollow post-receiving chamber 18. The central opening 56 is sized to permit insertion of a post 16 without contacting the inner surfaces 24 of the walls 14 at the upper portion of the body 12. In preferred form, a post engaging mechanism 58 is provided to securely fasten the upper portion 52 of the post 16 to the elongate body 12. The post engaging mechanism 58 is adapted to releasably secure the post 16 so as to permit ready exchange of the post 16 within the body member 12 when it is desired to do so, such as where the post 16 might be damaged. Moreover, the post engaging mechanism 58 permits adjustment of the vertical axis 60 of the post 16 relative to the vertical axis 22 of the body 12.

In one preferred embodiment of the present invention, the post engaging mechanism 58 includes a plurality of angular notches 62 formed in the plate 54 and walls 14. In preferred form, the notches 62 are disposed along the center portion of the upper edge 64 of each wall member 14. Each slot 62 includes a substantially U-shaped opening 66 in the plate 54, a substantially U-shaped opening 68 in the surface 24 of the wall member 14, and a slanted surface 70 that interconnects the U-shaped openings 66 and 68. In order to reduce the amount of metal utilized to form the elongate body 12, brackets 72 are formed along the outer surfaces of the walls 14 immediately beneath the plate 54 in order to form the slot 62. In addition, knobs 74 extend downwardly from the bottom of each bracket 72 and provide a solid body for the formation of apertures 76 in the surface 70 extending down through the knobs 74. The apertures 76 are provided as a portion of the anchor attachment mechanism described below.

To anchor the post in this embodiment, a plurality of retainer or lock tabs 78 are sized and shaped for form-fitting within the slots 62. Specifically, each retainer tab 78 of the preferred embodiment includes an upper surface 80, a front face 82, a lower surface 84, paired side surfaces 86 and an angular rear surface 88. The angular surface 88 is sized and angled so as to snugly fit against the inclined surface 70 of the slot 62. Thus, the retainer tab or anchor tab 78 slidingly moves within the slot 62. An elongated bore 90 is provided through the center of the retainer tab 78 passing through the upper surface 80 and out through the bottom surface 84 and slanted surface 88. A removable attachment member 92, preferably in the form of a bolt, is sized to pass through the elongated bore 90 and into the aperture 76. In this manner, when the attachment screw 92 is loosely secured within the aperture 76, the retainer tab 78 may move in an oscillatory lateral manner, as indicated by the arrow 93, along the length of the bore 90 within the slot 62. This permits the retainer tab 78 to laterally move into the opening 56 a selective distance. In preferred form, there are four such retainer tabs 78 disposed about the opening 56. When a post 16 is inserted into the opening 56 and positioned within the chamber 18, the retainer tabs 78 are moved against the outer surfaces of the post 16 to firmly position the faces 82 against the post 16.

In preferred form, fingers 94 project outwardly from the front face 82 and are adapted to press-fit into the surface of the post 16 when the post 16 is made from a pliable material such as wood. This provides greater grip between the retainer tabs 78 and the post 16. In addition, the fingers 94 may also be utilized to secure extensions (not illustrated) onto the front face 82 to extended the length of the retainer tabs 78 as well to provide a different curvature to the front face 82 if desired. Nonetheless, the post 16 may be of rectangular cross-section or annular cross-section, and the retainer tabs 78 still firmly mount and anchor the upper portion 52 of the post 16 to the plate 54. When the desired lateral position of each retainer tab 78 within its slot 62 is located, the attachment screw 92 is firmly secured within the aperture 76. By adjusting the relative lateral positions of the individual retainer tabs 78, the vertical alignment 60 of the post 16 may be adjusted and modified as desired relative to the vertical axis 22 of the elongate body 12. The angular surface 88 of the retainer or lock tab 78 enables pressure from the post to the retainer tab 78 to be transferred to the elongate body 12 rather than being carried entirely by the attachment bolt 92. In this manner, the likelihood of shearing of the bolts 92 is reduced when sudden pressure is exerted laterally against the post 16 such as by being hit by a vehicle or the like.

Once the post 16 has been placed within the post-receiving chamber 18 and the retainer tabs 78 adjusted and tightened in position, a rubber boot 95 may be positioned to cover the surface between the post 16 in the outer edge 98 of the plate 54. In preferred form, the boot 95 has a central aperture through which the post 16 is inserted. The boot 95 is then moved down over the length of the post, and the circumferential edges 96 of the boot 95 are then snugly slipped over the outer edge 98 of the plate 54. In one embodiment of the present invention, an upper collar or ears 100 is provided immediately about the post 16 and can be secured thereto to prevent inadvertent removal by nails 102 passing through the collar or ears 100 into the post 16. In this manner, the rubber cap or boot 95 prevents debris from being inadvertently dropped into the chamber 18 as well as deters theft inasmuch as the retainer tabs 78 and anchor mechanism of the present invention cannot be seen when the boot 95 is in place.

In an alternate embodiment of the anchoring mechanism of the present invention, a plurality of ears 104 are mounted on the plate 54. The ears 104 are positioned at the corner junctions 106 between the upper edges 64 of the walls 14. In this embodiment, each ear 104 includes a center elongated bore 108. An attachment screw 110 passes through the bore 108 into an aperture 112. The ears 104 are adapted to move laterally the length of the bore 108 when the screw 110 is loosely secured in the aperture 112 as in the prior embodiment. In preferred from, each ear 104 includes a Y-shaped front face 114 which forms a notch 116 therein. When the post 16 is inserted into the aperture 56, the ears 104 are moved laterally inwardly along the screws 110 until the notch 116 firmly nests against the corner of the post 16. If the post 16 is annular in from, the front corners 118 of the Y-shaped face 114 engage the annular post 16. In either event, when the ears 104 are firmly moved against the post 16, the screws 110 are tightly sect within the apertures 112 to maintain the position of the ears 104 and anchor the post 16. By relative lateral movement of the plurality of ears 104, the vertical alignment of the post 16 may be adjusted relative to the vertical axis 22 of the elongate body 12 as in the previous embodiment.

As can be seen from the above, the present invention provides a ground pocket support which may be permanently buried in the ground without requiring removal thereof should the post mounted therewithin require changing or removal. The support device of the present invention may be modified for increased length so as to eliminate the requirement of concrete to maintain the support device in position within the ground in many instances. Moreover, the ground pocket support of the present invention enables easy mounting and secure attachment of a post therewithin. In addition, moreover, the present invention is adaptable to receive posts of a wide variety of width dimensions as well as shapes without modification.

Should the post be sheared at ground level by impact from an automobile or the like, the residual portion of the post contained within the pocket support of the invention may be readily removed without removing the pocket support from the ground. This is due to the unique anchoring mechanism of the present invention. Moreover, the pocket support of the present invention may be inserted into the ground without requiring extreme care to ensure that the alignment of the pocket support is in fact true vertical. If the pocket support is not aligned along a true vertical, the vertical alignment of a post inserted therewithin maybe adjusted for proper alignment regardless of the alignment of the pocket support. As the result of the unique features of the present invention, fence posts, mailbox posts and the like may be easily mounted in the ground and may be readily replaced should replacement be required. In addition, a series of posts may be aligned to establish a fence or the like, and the vertical alignment of each post may be readily modified and adjusted after the post has been implanted in the ground by use of the present invention. This enables much quicker installation as well as replacement thereby creating substantial savings.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitable may be practiced in the absence of any element which is not specifically disclosed herein.

I claim:

1. A ground pocket support device for removably mounting a post having variable cross-section shape and size, said pocket support device comprising;

an elongate ground engaging member having upper and lower end portions and adapted for placement in the ground, said ground engaging member defining a hollow post-receiving portion for receiving and supporting said post in a substantially upright position and including elongate wall members and post wedging means positioned toward said lower end portion for firmly engaging the lower end of a post inserted therewithin; and a post-engaging member disposed at the upper end portion of said ground engaging member and including means for removably anchoring a post inserted within said ground engaging member and for adjusting the vertical alignment of said post independent of the vertical alignment between the ground engaging member and the ground in which it is placed.

2. The device as claimed in claim 1, wherein said ground engaging member has a rectangular cross-section.

3. The device as claimed in claim 2, wherein said ground engaging member has a square cross-section.

4. The device as claimed in claim 2, wherein said wall members taper from said upper end portion to said lower end portion approximately 1°–5° from the vertical axis of said ground engaging member.

5. The device as claimed in claim 1, wherein said post wedging means include a plurality of interior ledge members spaced about the inner surfaces of said wall members and adapted to engage the bottom surface of said post.

6. The device as claimed in claim 5, wherein each said spaced ledge member includes a plurality of progressively inwardly stepped sills from the interior of each said wall member interconnected by beveled surfaces to provide a plurality of wedged surfaces to receive post of variable width dimensions.

7. The device as claimed in claim 1, wherein said elongate ground engaging member includes an exterior rim disposed about the lower potion thereof, said rim and the lower portions of said wall members being sized and shaped to engage an elongated extension member.

8. The device as claimed in claim 1, wherein said post-engaging member comprises a top plate defining a central entry opening into said hollow post-receiving portion, said wall members depending from said top plate.

9. The device as claimed in claim 8, wherein said anchoring means comprises a plurality of post retainer members spaced about said plate and said central entry opening and adapted for adjustable lateral movement toward and away from the axis of said opening.

10. The device as claimed in claim 9, wherein each said post retainer member is secured for transverse lateral movement for adjustably engaging the side surface of a post positioned within said hollow post-receiving portion, said post retainer members interacting to maintain said post in selective vertical alignment.

11. The device as claimed in claim 10, wherein each said post retainer member is centered along one said wall member at said central entry opening for interaction with a side of said post.

12. The device as claimed in claim 10, wherein said post retainer members are positioned at the corner junctions of said wall members at said central entry opening for interaction with the corners of said post.

13. The device as claimed in claim 1, wherein said post-engaging member and said post wedging means are adapted to receive posts of rectangular and annular cross-section.

14. A ground pocket support for placement in the ground and adapted for removably mounting a post of variable width and shape therewithin, said support comprising;

an elongate body for placement in the ground and having upper and lower end portions, said body including a plurality of elongate wall members defining a central post-receiving portion;

means disposed in said lower end portion for firmly engaging the lowermost end of a post of variable cross-section width and shape positioned within said post-receiving portion; and means disposed at said upper end portion for removably anchoring said post positioned within said post-receiving portion and for adjusting the vertical alignment of said post independent of the vertical alignment of said elongate body as it is positioned in the ground.

15. The pocket support as claimed in claim 14, wherein said elongate body includes four elongate wall members having a substantially rectangular cross-section.

16. The pocket support as claimed in claim 15, wherein said elongate wall members are tapered from said upper end portion to said lower end portion at approximately 1°–5° from the vertical axis of said elongate body.

17. The pocket support as claimed in claim 16, wherein said taper is approximately 2°.

18. The pocket support as claimed in claim 17, wherein said post lowermost end engagement means comprises a plurality of stepped ledge members spaced along the interior surface of said wall members at said lower end portion, each said stepped ledge member including a series of laterally projecting steps to form laterally and vertically spaced sills for selective engagement with the end surface of said post, said sills being separated by an angular wedged surface adapted to increase lateral force on the end of said post as it is inserted into said post-receiving portion and seated onto one of said sills.

19. The pocket support as claimed in claim 14, wherein said post lowermost end engagement means comprises at least one interior ledge member having a wedged-shaped portion to laterally press against at least one side of said post as it is inserted into said central post-receiving portion.

20. The pocket support as claimed in claim 14, wherein said upper end portion includes a top plate defining a central opening coaxial with said central post-receiving portion and sized to receive posts of varying width dimension and shape.

21. The pocket support as claimed in claim 20, wherein said anchor means comprises a plurality of post retainer tabs spaced about said top plate surrounding said central opening, said retainer tabs being laterally adjustable relative to the axis of said central opening to firmly engage said post when disposed in said pocket support and interact with each other to move and maintain said post to an optimum vertical alignment.

22. The pocket support as claimed in claim 21, wherein said each said retainer tab includes a central slot and an attachment member disposed through said slot and secured to said plate, said attachment member fixing the lateral position of said tab relative to said plate when tightened, and permitting lateral movement and positional adjustment of said tab along the length of said slot when loosened.

23. The pocket support as claimed in claim 22, wherein each said retainer tab is centered along one said wall member to abut the surface of a rectangular post.

24. The pocket support as claimed in claim 23, wherein each said retainer tab includes teeth to grip the outer surface of said post.

25. A pocket support device for mounting a post of variable cross-section width and shape in the ground, said device adapted for ease of removal of said post in case of post damage as well as adjustable vertical alignment of said post, said device comprising:

an elongate ground engaging member having upper and lower portions and adapted for placement in the ground, said ground engaging member including four wall members defining a hollow post-receiving portion having a substantially rectangular cross-section for receiving and supporting said post in a substantially upright position;

means disposed in said lower end portion for firmly engaging the lowermost end of said post when positioned within said post-receiving portion; and a top plate member disposed at the upper end portion of said ground engaging member defining a central opening for said hollow post-receiving portion and including a plurality of anchor mounts secured to said plate about said opening for lateral adjustable engagement with said post to removably secure said post within said post-receiving portion and to provide adjustable vertical alignment independent of the vertical axis of said ground engaging member.

26. The device as claimed in claim 25, wherein said post lowermost end engagement means comprises a plurality of engagement elements spaced about the inner surface of said wall members, each engagement element including a plurality of laterally and vertically spaced steps for selectively supporting the end surface of said post.

27. The device as claimed in claim 26, wherein the steps of each said engagement element are spaced by beveled surfaces to provide a wedge-like surface against the bottom portion of said post to create lateral force against said post.

28. The device as claimed in claim 25, wherein said top plate member includes an angled notch disposed in the surface thereof at the center portion of each said wall member, each said anchor mount being sized and shaped to slidingly fit within said notch for lateral movement and selective attachment therewithin relative to the axis of said opening, said anchor mounts interacting to provided adjustable vertical alignment of said post relative to the vertical axis of said ground engaging member.

* * * * *